US007455479B2

(12) United States Patent
Kauschinger

(10) Patent No.: US 7,455,479 B2
(45) Date of Patent: Nov. 25, 2008

(54) METHODS AND SYSTEMS FOR MONITORING PRESSURE DURING JET GROUTING

(76) Inventor: Joseph Kauschinger, 200 Berry Glen Ct., Alpharetta, GA (US) 30022

( * ) Notice: Subject to any disclaimer, the term of this patent is extended or adjusted under 35 U.S.C. 154(b) by 0 days.

(21) Appl. No.: 11/456,130

(22) Filed: Jul. 7, 2006

(65) Prior Publication Data

US 2007/0014640 A1 Jan. 18, 2007

Related U.S. Application Data

(60) Provisional application No. 60/699,728, filed on Jul. 14, 2005.

(51) Int. Cl.
*E02D 3/12* (2006.01)

(52) U.S. Cl. ..... 405/266

(58) Field of Classification Search ..... 405/266, 405/269; 73/152.51
See application file for complete search history.

(56) References Cited

U.S. PATENT DOCUMENTS

| | | | | |
|---|---|---|---|---|
| 4,514,112 | A * | 4/1985 | Sano et al. | 405/269 |
| 4,647,853 | A * | 3/1987 | Cobern | 73/152.45 |
| 5,309,997 | A | 5/1994 | Nahm et al. | |
| 5,709,505 | A | 1/1998 | Williams et al. | |
| 5,785,131 | A | 7/1998 | Gray | |
| 5,791,825 | A | 8/1998 | Gardner et al. | |
| 5,836,390 | A | 11/1998 | Apps et al. | |
| 5,978,749 | A * | 11/1999 | Likins et al. | 73/11.03 |
| 6,109,836 | A | 8/2000 | Gritti | |
| 6,254,524 | B1 | 7/2001 | Kauschinger | |
| 6,675,914 | B2 | 1/2004 | Masak | |
| 2005/0103527 | A1 * | 5/2005 | Church et al. | 175/62 |

FOREIGN PATENT DOCUMENTS

| | | |
|---|---|---|
| EP | 0633361 A1 | 1/1995 |
| EP | 1045073 A1 | 10/2000 |

OTHER PUBLICATIONS

Susmann, et al., Vector Magnetics, RivCross Operating Manual Version 1.01, Mar. 2004.

* cited by examiner

*Primary Examiner*—John Kreck
(74) *Attorney, Agent, or Firm*—Sutherland Asbill & Brennan LLP

(57) ABSTRACT

A method for preventing soil fracture and/or monitoring borehole pressure during jet grouting that may include monitoring borehole pressure at one or more points in a jet grouting borehole while the jet grouting is being performed and determining whether the borehole pressure exceeds a predetermined limit. The method may further include providing notification to a jet grouting operator that there is a high risk of soil fracture if the borehole pressure exceeds the predetermined limit. The predetermined limit may be the estimated fracture pressure of the soil in which the jet grouting is being performed.

8 Claims, 2 Drawing Sheets

METHODS AND SYSTEMS FOR MONITORING PRESSURE DURING JET GROUTING

CROSS REFERENCE TO RELATED APPLICATION

This application claims priority under 35 U.S.C. §119(e) to U.S. Provisional Application 60/699,728 filed on Jul. 14, 2005, the disclosure of which is expressly incorporated by reference in its entirety.

TECHNICAL FIELD

This present invention relates generally to methods and systems for monitoring pressure during jet grouting operations. More specifically, the present invention relates to methods and systems for monitoring borehole pressure during jet grouting operations such that soil fracturing and other undesirable conditions may be avoided.

BACKGROUND OF THE INVENTION

Jet grouting has been in commercial use since approximately 1975. In general terms, the technology may be used to efficiently remove underground soils with a high-pressure jet erosion process and replace the removed soil with a stabilization material (i.e., grout). In this way, ailing structures, such as buildings or dams with sagging foundations, may be remediated.

For the jet grouting process to proceed successfully, there generally is a requirement that there be a continuous flush of cuttings (i.e., removed soil) from the point of mixing at the bottom of the drill hole where the jet grouting process is performed. The cuttings need to be removed upward and away from the jet grouting process, typically to the surface. However, if the flow of cuttings to the surface is disrupted along any point of the flow path, the ultra-high injection pressures (3,000 psi-15,000 psi) of the jet grouting process may cause the borehole pressure between the blockage and point of injection to rise to a level that exceeds the fracturing pressure of the soil and, thus, cause a fracture therein. If a soil fraction occurs, the injected stabilization material typically flows away from the borehole and out into the surrounding formation, which prevents the stabilization material from performing its intended purpose. More significantly, though, a soil fracture may cause a mass movement of soil underground, which in turn can lead to severe damage to the foundation of the structure that the jet grouting was intended to repair.

The vagaries of the jet grouting process make is difficult to predict by observation or computer modeling when the fracture pressure of soils may be exceeded. For example, at times the cuttings from the jet grouting process may flow into underground pockets (and not to the surface) such that, while it may appear to an observer at the surface that the flow of cuttings has been interrupted, the process is proceeding with no harmful buildup of pressure. At other times, though, the fracturing pressure of the soil may be exceeded even while there is a flow of the cuttings to the surface because, as it has been found in practice, borehole pressure also is related to the density and rhealogy (viscosity) of the soil cuttings generated during the jet grouting.

As such there is long-felt need for a method or system that may provide a warning to the operators at the surface as to when there is a high risk of soil fracturing during jet grouting due to build up of pressure either in the borehole or along the injection rod. Such a method or system may allow corrective action to be taken so that the jet grouting process can proceed successfully and damage to structures can be prevented. Other objects, features and advantages of the invention will be found throughout the following description, drawings and claims.

SUMMARY OF THE INVENTION

The present application thus may describe a method of preventing soil fracture and/or monitoring borehole pressure during jet grouting that may include monitoring borehole pressure in a jet grouting borehole while the jet grouting is being performed and determining whether the borehole pressure exceeds a predetermined limit. The method may further include providing notification to a jet grouting operator that there is a high risk of soil fracture if the borehole pressure exceeds the predetermined limit. The predetermined limit may be the estimated fracture pressure of the soil in which the jet grouting is being performed.

In other embodiments, the present invention may include a method of preventing soil fracture and/or monitoring borehole pressure during jet grouting that may include monitoring borehole pressure in a jet grouting borehole while the jet grouting is being performed and determining whether the borehole pressure increases at a rate exceeding a predetermined rate. The method may further include providing notification to a jet grouting operator that there is a high risk of soil fracture if it is determined that the borehole pressure increases at a rate exceeding a predetermined rate. The predetermined rate may be an approximate increase of approximately 10 psi over a period of 10 seconds. In particular embodiments, the borehole pressure can be monitored at one or more points in a jet grouting borehole. In other embodiments in which compressed air is used as a jetting fluid, the borehole pressure can be determined by monitoring the air pressure and flow rate of the compressed air into the borehole.

In other embodiments, the present invention may include a system for preventing soil fracture and/or monitoring borehole pressure during jet grouting with a jetting tool that may include one or more pressure sensors associated with the jetting tool for measuring the borehole pressure in a jet grouting borehole and means for determining whether the pressure measured in the borehole exceeds a predetermined limit. The system further may include an alarm for providing notification to a jet grouting operator that there is a high risk of soil fracture if the borehole pressure exceeds the predetermined limit.

In other embodiments, the present invention may include a system for preventing soil fracture and/or monitoring borehole pressure during jet grouting with a jetting tool that may include one or more pressure sensors associated with the jetting tool for measuring the borehole pressure in a jet grouting borehole and means for determining whether the borehole pressure increases at a rate exceeding a predetermined rate.

According to another embodiment, this invention encompasses a method of determining borehole pressure in a jet grouting borehole during jet grouting comprising injecting pressurized air into the borehole at a flowrate sufficient for the pressurized air to travel through the borehole at a predetermined speed, determining a reference pressure of the pressurized air necessary for the pressurized air to travel at the predetermined speed into the borehole at a reference borehole depth, determining a second pressure of the pressurized air necessary for the pressurized air to travel at the predetermined speed into the borehole at a second borehole depth deeper than the reference borehole depth, and comparing the reference pressure to the second pressure.

These and other features of the present invention will become apparent upon review of the following detailed description of the preferred embodiments when taken in conjunction with the drawings and the appended claims.

DETAILED DESCRIPTION OF EXEMPLARY EMBODIMENTS

Figure 1C:
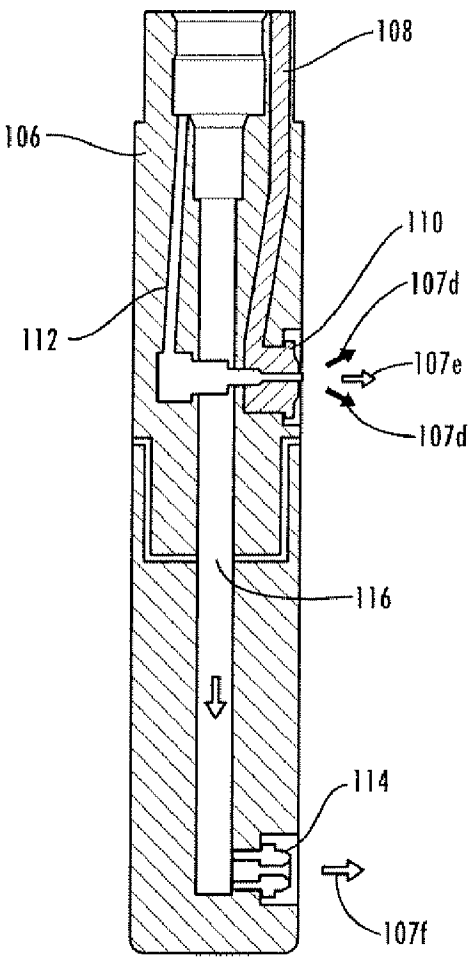
FIGS. 1(*a*), (*b*) and (*c*) are cross-sectional schematic plans for exemplary tools used in the three common types of jet grouting.
Figure 1B:
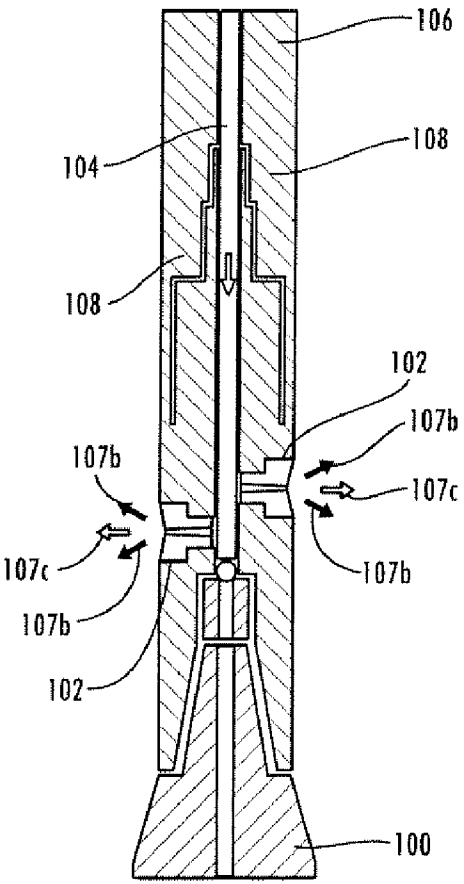
Figure 1A:
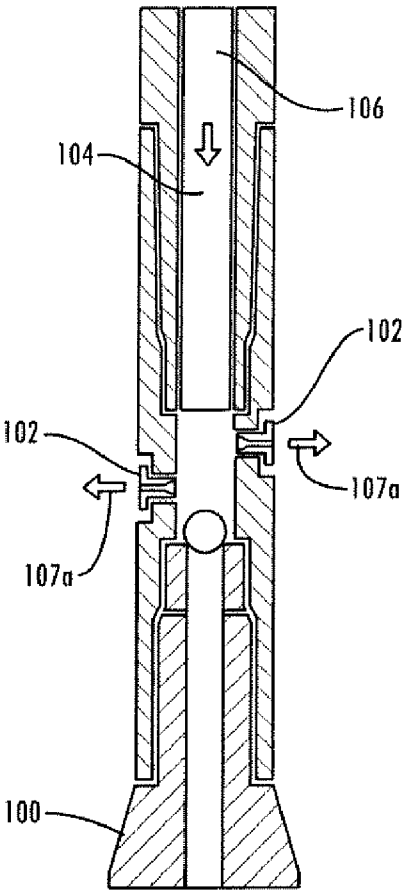

Jet grouting is a high speed jet erosion process in which ultra-high pressures (3,000 to 15,000 psi) are used to impart energy to a set of cutting and mixing jets. As demonstrated in FIG. 1, there are three major forms of jet grouting. They are identified as single fluid jet grouting, as shown in FIG. 1(*a*), double fluid jet grouting, as shown in FIG. 1(*b*), and triple fluid jet grouting, as shown in FIG. 1(*c*).

Single fluid jet grouting is a process using a single fluid (usually of water mixed with cement components or grout) that is injected into the soil for purposes of modifying the mechanical properties of the in situ material. FIG. 1(*a*) demonstrates a typical schematic of the jetting tool used to perform single jet grouting. Such a jetting tool may include a bit 100 for drilling the apparatus into the soil and one or more nozzles 102 for emitting a jet (indicated by arrows 107*a*) of high pressure water and cement mix or grout. The cement mix may be sent down a channel 104 that is located within a rod 106. The appliance which holds the jetting nozzles is generally termed a jet grout monitor.

Double fluid jet grouting is a process whereby the cement grout jet utilized in single fluid jet grouting is encapsulated within a cone of compressed air (i.e., a second fluid). FIG. 1(*b*) demonstrates a typical schematic of the jetting tool used to perform double jet grouting. This jetting tool also may include a bit 100 for drilling the apparatus into the soil and one or more nozzles 102 for emitting a cone of compressed air (indicated by darker arrows 107*b*) and a spray of high pressure grout (indicated by lighter arrow 107*c*). The grout may be sent down a channel 104 that is located within the rod 106. The compressed air may be sent down compressed air channels 108. The compressed air allows the grout jet to project its energy farther into the ground, thus making a larger area of ground stabilization possible with the use of an inexpensive material such as compressed air.

Triple fluid jet grouting is a process which separates the cutting and stabilization of the soil by using a triple entry-way of concentric drilling/injection rods. FIG. 1(*c*) demonstrates a typical schematic of the jetting tool used to perform triple jet grouting. This jetting tool may include an upper nozzle 110 for emitting a cone of compressed air (indicated by darker arrows 107*d*) and a spray of high pressure water (indicated by lighter arrow 107*e*). The water may be sent down a water channel 104 that is located within the rod 106. The compressed air may be sent down compressed air channels 108. The initial cutting of the soil is performed using a high pressure water jet encapsulated within compressed air, similar to double fluid jet grouting with water replacing the grout jetstream. Beneath the composite water-air jetstream is a cement grout injection nozzle 114. The grout is delivered to the grout nozzle 114 by a grout channel 116. The grout nozzle 114 is used to inject the stabilizing agents into the ground (indicated by lighter arrow 107*f*). Alternatively, this method can be performed without the compressed air, in which case, water with out compressed air is used to initially cut the soil, and the cement grout is simultaneously injected through a jet at a lower elevation of the injection rods.

Figure 2:
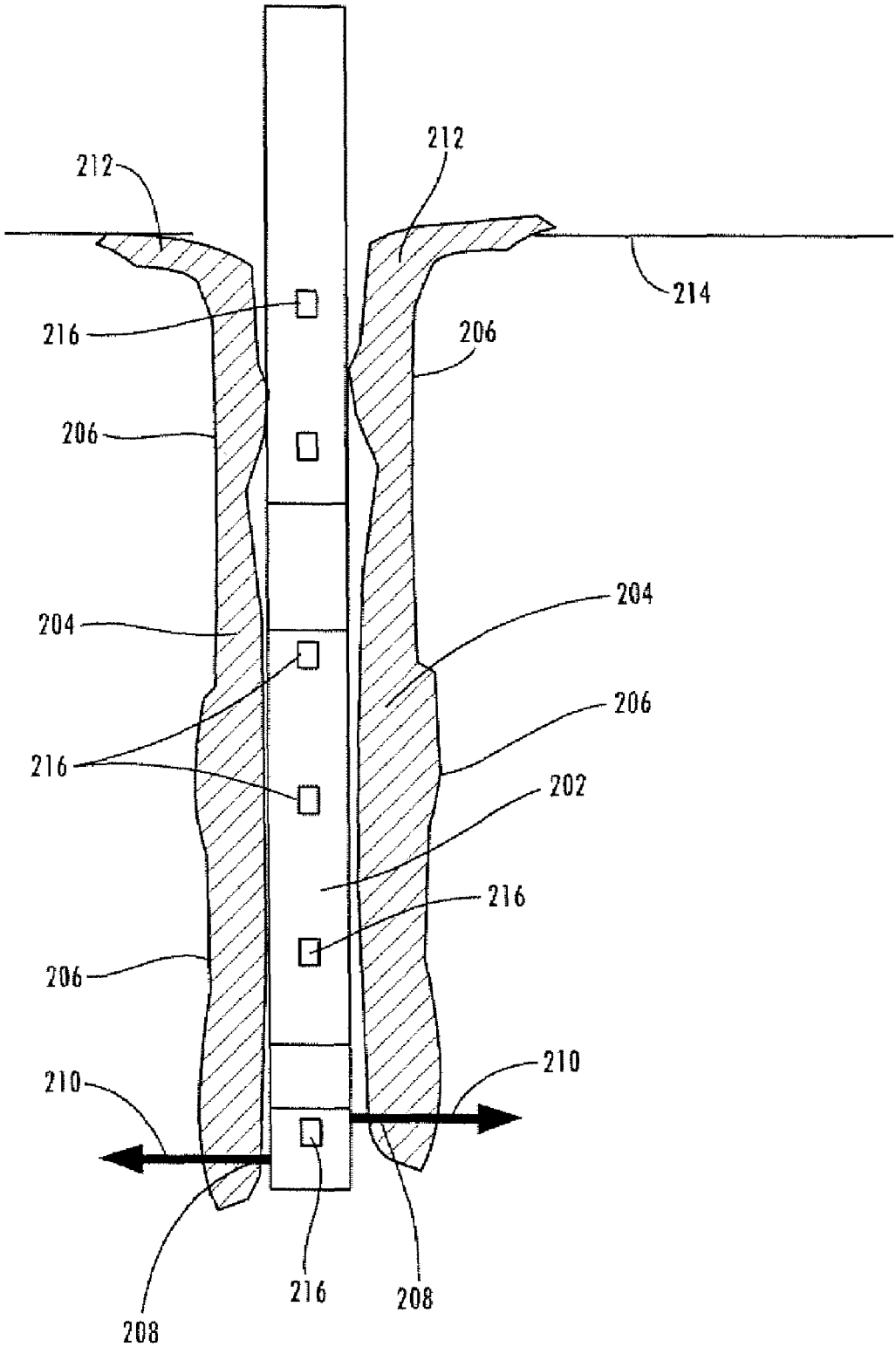
FIG. 2 is cross-sectional schematic plan demonstrating the jet grouting process and an embodiment of the present invention.

The generalities of the jet grouting process are demonstrated in the section view of FIG. 2. These may be common to all types of jet grouting. Jet grouting may include a rod 202 that extends down a borehole 204. The borehole 204 may be delineated by outer limits 206. At the end of the rod 202, a nozzle 208 may emit a high pressure stream 210 of grout, air and/or water, depending on the type of jet grouting. The high pressure stream 210 may erode the surrounding soils and replace the soil with a stabilization mix (i.e., grout). The erosion process forces cuttings 212 upward to the surface 214.

For each of the three above jet grouting processes there is a fluid mechanics requirement that there be a continuous flush of cuttings 212 from the point of mixing at the bottom of the borehole 204 (where the jet grouting process is performed) to an atmospheric condition, typically at the surface 214. If the flow of cuttings to the surface is disrupted along any point of the flow path, then the borehole pressures between the blockage and point of injection may rise significantly. The borehole pressure may rise to a level equal to the fracturing pressure of the surrounding soil formation. If the soil fracturing pressure is exceeded, a soil fracture will take place. As used herein, a "soil fracture" or "fracture" is defined as the breaking apart of a soil formation and other undesirable consequences that result from the application or build up of excessive pressure that may be applied during a jet grouting operation. A soil fracture may result in the stabilization material flowing away from the borehole and into the fracture and surrounding soil formation (and away from the intended stabilization area), which may prevent the stabilization material from performing its intended purpose. Further, a soil fracture may cause a mass movement of underground soils, which in turn may lead to severe damage to the foundations of the structures located on the ground above.

Soil fractures also may take place even when there is a flow of the cuttings 212 to the surface 214, as it has been found in practice that the fracturing pressure of the formation still may be exceeded. This may be explained by the fact that borehole pressure is also related to the density and rhealogy (viscosity) of the cuttings 212 generated during jet grouting. As the density and viscosity of the cuttings 212 increase so does the borehole pressures generated in situ. Thus, very dense and viscous cuttings 212 also may cause a soil fracture even where there appears to be an outflow of cuttings 212 at the surface 214.

As further shown in FIG. 2 and described herein, the current invention may integrate systems and devices into or into operative association with standard jet grouting equipment, such as those illustrated in FIGS. 1(*a*), 1(*b*) and 1(*c*), so that the hydraulic pressure that develops in the borehole 204 may be monitored during the jet grouting process so that soil fractures can be avoided. Such a system may be called a jet grouting pressure monitor. In general, the jet grouting pressure monitor may include certain on-board instrumentation, which may be described as instrumentation and devices that are installed within the jetting tool or jet grouting rod 202 and function within the borehole 204 during the jet grouting operation or, for some systems using pressurized air as an injection fluid, the monitor includes a device for measuring the air pressure and flow rate of the compressed air into the borehole. These instruments and devices and may include certain OEM instrumentation—i.e., known devices and instrumentation that may be packaged and adapted for use in the jet grouting application—and pressure sensors, which may include pressure transducers, Silicon Micromachine Pressure Gauges, Piezo Resistive Silicon Resistors, or Piezo Electric Fluoropolymer Film and Cable products, flow meters, developed or available software, a computer or other computing means known in the art, data transmission means (which is discussed in more detail below), and a power supply. At the surface 214, the system may include receivers, display and control instrumentation for receiving, displaying the pressure readings taken in the borehole and for controlling certain aspects of the jet grouting operation. These devices are general known in the art and may include receivers, a computer or computing means with ability to download data using a USB port or similar data link, and display units.

Note that in some embodiments data transmission means may not be needed. For example, in one embodiment, an instrumentation package may be installed at the bottom of the jetting tool that may receive and record the pressure measurements of the borehole from the pressure transducers or gauges as they occur. When the device is brought to the surface after the jet grouting operation is completed, the device may download the pressure data via a data link to a computer where the readings may be analyzed. The availability of such data in the field is valuable in adjusting borehole pressure calculations for the next jet grouting operation (i.e., generally several jet grouting boreholes are done in a single remediation project). Certain borehole pressure calculations may be made as the jet grouting operation is being performed and generally are based on the measured viscosity of the cuttings, the flow rate observed from the top of the borehole, the size of the annular opening around the rod 202, and the injection rate and pressure of the grout, water, and/or air mixture. Having actual pressure data available after the jet grouting operation has been completed allows comparisons to be made between actual pressures measured and the calculations made at the surface based on the observations of the process. The comparison then may be used to adjust later calculations such that field conditions are better taken into account.

In another embodiment where data transmission means may not be necessary, a computerized controller, such as those known in the art, may be placed within the on-board instrumentation (i.e., the devices and equipment that are integrated into the equipment in the borehole 204) and may automate the process from within the borehole 204 during the jet grouting operation. The controller may react to the pressure readings it receives and control the jet grouting process according to programmed rules based upon either pressure limits that should not be exceeded or rapid increases in pressure that may be treated as warning signs, as discussed in more detail below. This type of automated system, for instance, may decrease the jet grouting injection pressure in response to the borehole pressure exceeding a certain level.

One or more pressure transducers or gauges 216 may be located at the bottom of the jet grouting rod 202 (near the nozzles 208) and/or along the rod 202 at certain locations so that pressure readings may be taken at the bottom of the borehole 204 and/or at intervals along its length, as demonstrated in FIG. 2. In addition, there is an available product that essentially is a cable that reads pressure along its length which would allow borehole pressure to be measured continuously along the length of the borehole 204 if such were installed along the length of the rod 202. The pressure transducers 216 may be a miniaturized, silicon based pressure transducer (as discussed above), though other pressure transducers or gauges known in the art may be used. In some embodiments, the power source for the pressure transducer 216 may be an on-board rechargeable battery so that the use of a pressure transducer or gauge 216 that requires low voltage/current requirements may be beneficial.

The instrumentation and power supply that relates to the pressure transducer 216 may be mounted within a drill rod sub-structure, which can be attached just above the jet grouting monitor for either the single, double or triple fluid jet grouting systems. This type of mounting may allow easy access to the compressed air channels 108 that are found in the double and triple fluid jet grouting systems. As discussed in more detail below, the compressed air channels 108 may provide a channel for data transmission between the pressure measuring module, i.e., the pressure transducer 216, and data relay stations that may be embedded within the compressed air-ways within the jetting rods.

The pressure transducers 216 may measure the hydraulic pressure in the borehole 204 as the jet grouting operation is being performed. These measurements essentially may be taken on a continuous basis during the jet grouting operation. The pressure measurements may be recorded by the on-board instrumentation package and, in some embodiments, then relayed on a continuous basis to the surface by the data transmission package (discussed in more detail below) where it might be received by the surface instrumentation package for display to an operator. As discussed herein, the computerized equipment and devices necessary to record the pressure measurements and relay the data to the surface for display are known in the art. The identification above of types of specific equipment is not meant to be limiting, only exemplary. Thus, the operators may receive pressure readings that provide the current pressure in the borehole 204 as the jet grouting operation proceeds. In this manner, operators (whether being at the surface or an on-board computer program) may identify conditions that present a risk of soil fracture and act accordingly.

Alternatively, with jet grouting systems using compressed air as a jetting fluid, the method of monitoring the borehole pressure can include monitoring the air pressure and flow rate of the compressed air into the borehole and calculating the borehole pressure. Such measurements can be made at the surface. The speed of compressed air from the jetting tool into the borehole can vary considerably depending on factors such as soil type and conditions and objectives of the jet grouting. In many applications, the speed of compressed air from the jetting tool into the borehole at supersonic speed or more to achieve penetration of the soil and a coherent jet of the air and water. Typically, the flow rate of compressed air from the jetting tool into the borehole ranges from about 1 to about 8 cubic meters per minute. The jetting tool is operated at or near the surface of the borehole to determine the pressure necessary to achieve the desired flow rate and speed of the compressed air. The minimum net pressure to achieve supersonic speed with the compressed air at or near the surface of a borehole is typically about 7 bars gauge pressure. As the jetting tool travels deeper into the ground, the pressure necessary to maintain the speed and flow rate of the compressed air increases. The difference between the pressure necessary to maintain the speed and flow rate of the compressed air at the surface and the pressure necessary to maintain the same speed and flow rate of the compressed air deeper in the ground is an approximation of the borehole pressure. Thus, an embodiment of this invention encompasses a method of determining borehole pressure in a jet grouting borehole during jet grouting comprising injecting pressurized air into the borehole at a flowrate sufficient for the pressurized air to travel through the borehole at a predetermined speed, determining a reference pressure of the pressurized air necessary for the pressurized air to travel at the predetermined speed into the borehole at a reference borehole depth, determining a second pressure of the pressurized air necessary for the pressurized air to travel at the predetermined speed into the borehole at a second borehole depth deeper than the reference borehole depth, and comparing the reference pressure to the second pressure. A very accurate flow meter for measuring the compressed air flow rate is desirable and a particularly effective flow meter is a Micro Motion Coriolis flow meter available from Micro Motion, Inc. of Boulder, Colo., an Emerson Process Management Company.

In certain embodiments, the system may be controlled by software, the design of which is known in the art, that monitors the pressure readings and provides an alarm such as by alerting the operators if certain pressure limits are exceeded and/or when there is a rapid increase in borehole pressure. This alarm may be of any type, including a change in a computer display, sound from the computer, etc. When these conditions are satisfied, the alert may notify the operators that a dangerous probability of soil fracture may exist and that corrective action should be taken (or the system may automatically perform the corrective measures) so that an unfavorable consequence may be avoided.

The pressure limits at which point an alert is sent may be configured according to the types of soils and other relevant geological conditions found in the area in which the jet grouting is being performed, as well as field data collected from previous jet grouting operations. In general, jet grouting is performed at pressures between 3,000 and 15,000 psi. In certain soils for examples soil fractures are common when the hydraulic pressure in the borehole 204 reaches between 0.25 psi and 1 psi per vertical foot of drilling depth, though many local variables such as soil type and compactness may affect this range. Accordingly, the jet grouting pressure monitor of the present invention, in certain embodiments, may provide notice to the operator when pressures near this soil fracture pressure level.

In certain other embodiments, the jet grouting pressure monitor may monitor the pressure readings to determine when a rapid increase in borehole pressure occurs. Rapid increases in borehole pressure may indicate that the flow of cuttings 212 has been disrupted in their flow to the surface. If a blockage is present and, if corrective measures are not taken, excessive pressure may build to a level equal to the fracturing pressure of the surrounding soil formation, and a soil fracture may occur. In other words, the jet grouting pressure monitor may monitor the pressure readings to determine whether the borehole pressure increases at a rate exceeding a predetermined rate. Rapid increases in borehole pressure (even where fracture pressure is not yet neared) may provide an early warning that a blockage is present. Under certain conditions, a rate of increase of approximately 10 psi over a period of 10 seconds may be used to determine is a blockage is present. In such cases, corrective measures may be applied before a fracture pressure is neared in the borehole 204 and substantial risk incurred.

At other times, as mentioned above, the cuttings 212 from the jet grouting process may flow into underground pockets (and not to the surface) such that, while it may appear to an observer at the surface that the flow of cuttings 212 has been interrupted, the process is proceeding with no harmful buildup of pressure. These pockets may exist extensively in soil types with a high composition of gravel and the absorption rate of these types of soils may be high such that cuttings 212 are not observed flowing from the top of the borehole 204. In such a case, there might be a question as to whether soil fracture occurred and whether the remediation job was performed correctly. The recorded pressure readings from the jet grouting pressure monitor may be used to establish that fracturing pressure levels did not occur during the operation and that the job was a success.

In general terms, the jet grouting may be used to efficiently remove underground soils with a high-pressure jet erosion process and replace the removed soil with a stabilization material (i.e., grout). In this way, ailing structures, such as buildings or dams with sagging foundations, may be remediated. Embodiments of this invention are particularly effective in stabilizing and reinforcing earthen dams. The invention described herein may allow the jet grouting process to be performed more efficiently and without less risk of damaging nearby structures because of soil fractures or other undesirable consequences caused by the jet grouting. For example, this invention may encompass a method for monitoring borehole pressure during jet grouting that includes: (1) monitoring borehole pressure at one or more locations in a jet grouting borehole during jet grouting in the borehole, (2) collecting borehole pressure data from said monitoring of the borehole pressure, and (3) comparing the collected borehole pressure data to predetermined pressure data. Based on the comparison, the jet grouting can be altered as necessary to control the borehole pressure and prevent soil fracture.

In certain other embodiments, the flow of either compressed air (in double/triple fluid jet grouting systems), the flow of water (in the triple fluid jet grouting system), or the flow of grout (in the single fluid jet grouting system) may be used in conjunction with a mini-hydropower generator (not shown) as a power generation source for creating the electric potential to power the necessary on-board instrumentation related to the pressure measuring module. This mini-hydropower generator may also be used to power other on-board instruments, such as inclinometers.

Data transmission between the on-board instrumentation and the surface (where the readings may be used by the operators) may be done in several ways. First, an instrument package may be installed that has on-board modules that acquire in real time borehole pressure data during the jet grouting process. Once the instrumentation package is retrieved at the surface (after the jet grouting operation is completed), the data may be downloaded and examined. The pressure data may be analyzed to examine if fracturing of the formation occurred. This retrievable instrumentation package is appropriate for use for all three forms of jet grouting.

Second, data transmission may be done through data wires installed in the jetting tool and rod 202 that connect the surface display and computing equipment to the pressure measuring devices in the borehole 204. In one embodiment, the typical drill rods 202 used in the double and triple fluid jet grouting systems (see FIGS. 1*b* & 1*c*) have compressed air channels 108 that are used to convey compressed air from the surface down to the jet tool. The pressure inside of the compressed air channels 108 is typically between 100 to 300 psi. Accordingly, the compressed air channels 108 may be used to install data transmission wires for transferring the borehole pressure measurements to the surface for processing in real time. The borehole pressures may be displayed on a computer screen and there may be set-point alarms to warn operators if there is a high risk of soil fracturing. In another embodiment, channels may be milled in the surface of the rod 202. These channels may act as conduits for the data wires and protect the wires during the jet grouting. In yet another embodiment, the data wires may be contained in the "wings" which are essentially protrusions or flanges formed on the surface of some jet grouting rods 202. These wings, also know as keystocks, are placed on the rod so that when the rod 202 is rotated during the jet grouting operation the wings keep the annular opening of the borehole 204 open, which allows for the unimpeded flow of cuttings 212 to the surface 214. These wings may be manufactured with interior channels that may be used as a conduit for data wires.

Third, wireless transmission of the borehole pressures also may be accomplished via use of relay stations embedded within the outer surface of the double and triple fluid jet grout systems drill rods 106. The relay stations may be adjustable in the three major axis so that the alignment of the rod mounted instruments may be adjusted in the field to account for any irregularities which occur when making-up the double or triple fluid drill string (i.e., tightening the rods). The wireless relay stations may use data transmission via optical or radio wave transmission conveyed along the inside of the compressed air port. Electrical transmission along the surface of the drill rod, with use of the relay stations as a signal enhancer module, may also be used.

Fourth, radio wave transmission from the on-board instrumentation directly through the ground to the surface instrumentation may also be used. Jet grouting operations are typically done at depths less than 100 meters (325 feet). This approach may be used for all three jet grouting systems.

These data transmission means further may be used to transmit other useful data to the surface that may improve the jet grouting process. For example, data taken by inclinometers measures the inclination of the jetting tool as it is drilled into the ground. This information is valuable in that it may allow an operator to determine the degree to which the jetting tool deviates from an intended path as it is drilled into the ground. The data transmission methods discussed above may allow the real time feed back of measurements taken by an inclinometer as the jetting tool is drilled into the ground, which may be beneficial to the jet grouting process. Other such data, such as temperature measurements, may also be beneficial to the jet grouting process if the data is received in real time while the jet grouting process is being performed. As such, the data transmission systems discussed above may be used to transmit all types of data associated with jet grouting (and other drilling operations). This may be beneficial to the process because it allows real time analysis to take place and changing conditions can be reacted to as they occur.

Further, the inventive concept described herein is not limited to a jet grouting application. The jet grouting application is exemplary only. Other such similar processes, many of which may be found in the oil recovery industry, may benefit from the real time monitoring of pressure within a borehole or drillhole so that soil fracture and other undesirable consequences may be avoided.

It should be apparent that the foregoing relates only to the preferred embodiments of the present invention and that numerous changes and modifications may be made herein without departing from the spirit and scope of the invention as defined by the following claims and the equivalents thereof.

I claim:

1. A method of preventing soil fracture during jet grouting, comprising:

monitoring borehole pressure in a jet grouting borehole while the jet grouting is being performed; and determining whether the borehole pressure exceeds a predetermined limit or determining whether the borehole pressure increases at a rate exceeding a predetermined rate, wherein the step of monitoring the borehole pressure comprises:

injecting pressurized air into the borehole at a flow rate sufficient for the pressurized air to travel through the borehole at a predetermined speed;

determining a reference pressure of the pressurized air necessary for the pressurized air to travel at the predetermined speed into the borehole at a reference borehole depth;

determining a second pressure of the pressurized air necessary for the pressurized air to travel at the predetermined speed into the borehole at a second borehole depth deeper than the reference borehole depth; and comparing the reference pressure to the second pressure to determine the borehole pressure.

2. Method as in claim 1 wherein the jet grouting borehole extends from a surface to a depth beneath the surface and the reference borehole depth is at or proximate to the surface.

3. Method as in claim 1 wherein the step of comparing comprises subtracting the reference pressure from the second pressure.

4. Method as in claim 1 wherein the predetermined speed is at least supersonic speed.

5. A method of determining borehole pressure in a jet grouting borehole during jet grouting, comprising:

injecting pressurized air into the borehole at a flowrate sufficient for the pressurized air to travel through the borehole at a predetermined speed;

determining a reference pressure of the pressurized air necessary for the pressurized air to travel at the predetermined speed into the borehole at a reference borehole depth;

determining a second pressure of the pressurized air necessary for the pressurized air to travel at the predetermined speed into the borehole at a second borehole depth deeper than the reference borehole depth; and comparing the reference pressure to the second pressure.

6. Method as in claim 5 wherein the jet grouting borehole extends from a surface to a depth beneath the surface and the reference borehole depth is at or proximate to the surface.

7. Method as in claim 5 wherein the step of comparing comprises subtracting the reference pressure from the second pressure.

8. Method as in claim 5 wherein the predetermined speed is at least supersonic speed.

* * * * *